United States Patent [19]

Ermanski

[11] Patent Number: 4,569,498

[45] Date of Patent: Feb. 11, 1986

[54] COPY HOLDER

[75] Inventor: Albert G. Ermanski, Auburn, Mass.

[73] Assignee: Wright Line Inc., Worcester, Mass.

[21] Appl. No.: 505,605

[22] Filed: Jun. 20, 1983

[51] Int. Cl.[4] ..... A47B 19/00

[52] U.S. Cl. ..... 248/441.1; 248/447.1

[58] Field of Search ..... 248/104, 441.1, 160, 248/274, 442.2, 447.1, 447.2; 403/161

[56] References Cited

U.S. PATENT DOCUMENTS

| | | | |
|---|---|---|---|
| 397,389 | 2/1889 | Richards | 403/161 |
| 2,111,368 | 3/1938 | Kron | 248/160 |

FOREIGN PATENT DOCUMENTS

| | | | |
|---|---|---|---|
| 10209 | of 1913 | United Kingdom | 248/274 |
| 524002 | 7/1940 | United Kingdom | 248/274 |

*Primary Examiner*—J. Franklin Foss

*Attorney, Agent, or Firm*—Milton E. Gilbert; Gary E. Ross

[57] ABSTRACT

Copy holder includes a flexible rise connecting a document support assembly to a clamp assembly. The invention provides facilitated vertical line of sight operation of a computer entry terminal.

15 Claims, 5 Drawing Figures

COPY HOLDER

BACKGROUND OF THE INVENTION

This invention relates to a copyholder for use with keyboards and in particular for use with a computer entry terminal such as a word processor.

Word processors have become commonplace in the office of today. Typically, the word processor employs a keyboard unit separate from a video display. It has been found that efficiencies are gained by placing materials to be entered into the word processor at a location between the keyboard and the video display. This has become known as "vertical line of sight" operation. To that end, various copyholders have been adapted for use with word processors so as to achieve this vertical line of sight capability.

OBJECTS OF THE INVENTION

Accordingly, it is an object of the present invention to provide a copyholder for use with word processors or other computer entry terminals.

Another object of the present invention is to provide a copyholder which can support media documents to be used as reference materials for keyboard operators.

Yet another object is to provide a copyholder which can be used for vertical line of sight operation of a computer entry terminal.

SUMMARY OF THE INVENTION

In general, a copyholder when made in accordance with this invention comprises a flexible elongated riser connected between a support unit and a clamp. The support unit includes a bottom ledge or platform connected at an angle to a planar support surface or vertical rest. The clamp assembly includes an immovable jaw and a coacting movable jaw preferably comprising an adjusting thumb screw.

In accordance with the invention the flexible riser is pivotally connected to the support unit and to the clamp assembly so as to permit pivotal motion about vertical axes. The flexible riser itself is bendable, so as to permit, in combination with the pivotal connection's, placement of the support unit as desired.

BRIEF DESCRIPTION OF THE DRAWINGS

The objects and advantages of this invention will become more apparent by reading the following detailed description in connection with the accompanying drawings, in which.

DESCRIPTION OF THE PREFERRED EMBODIMENT

Figure 1:
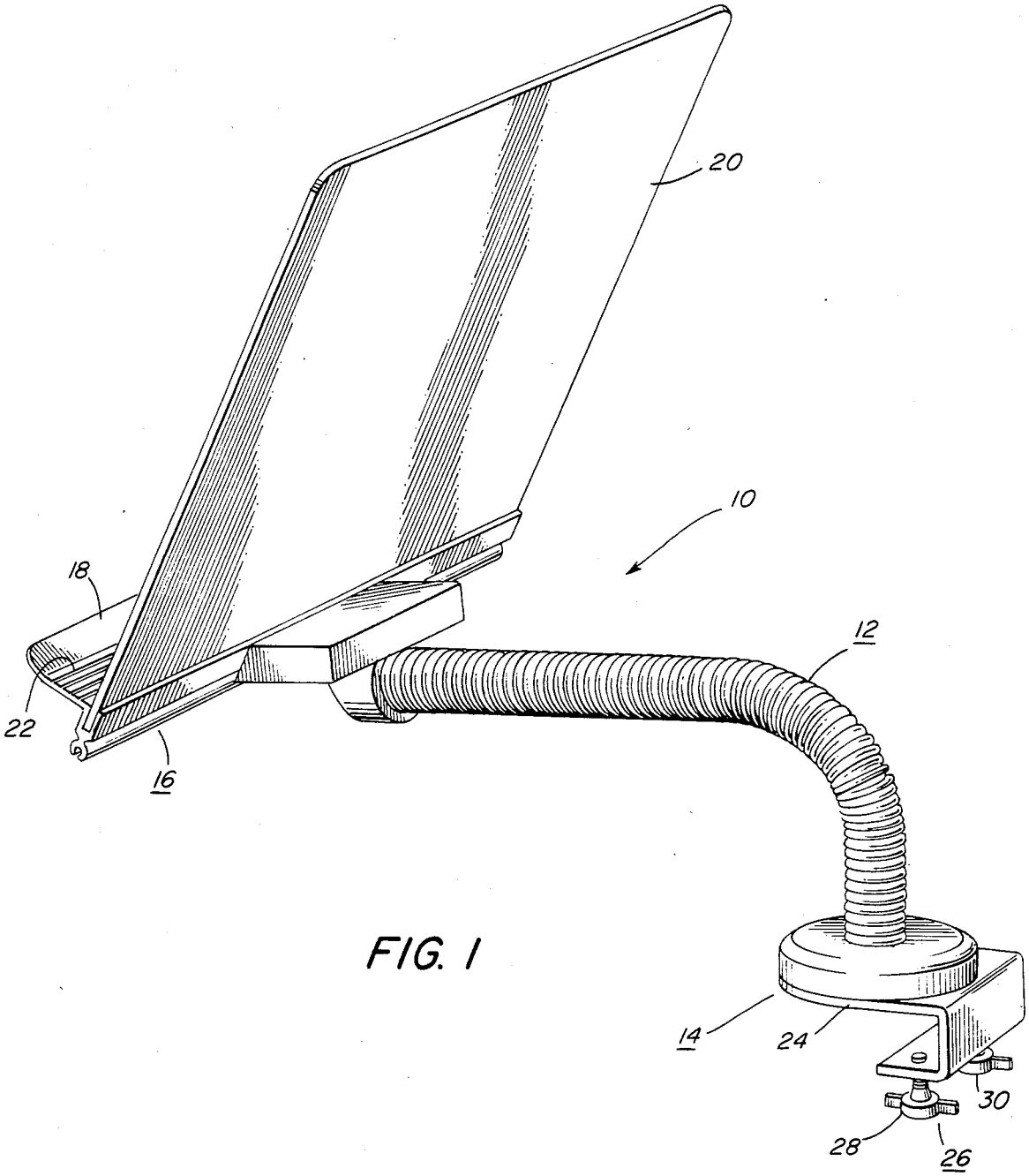
FIG. 1 is a perspective view of a copyholder made in accordance with this invention.
Figure 2:
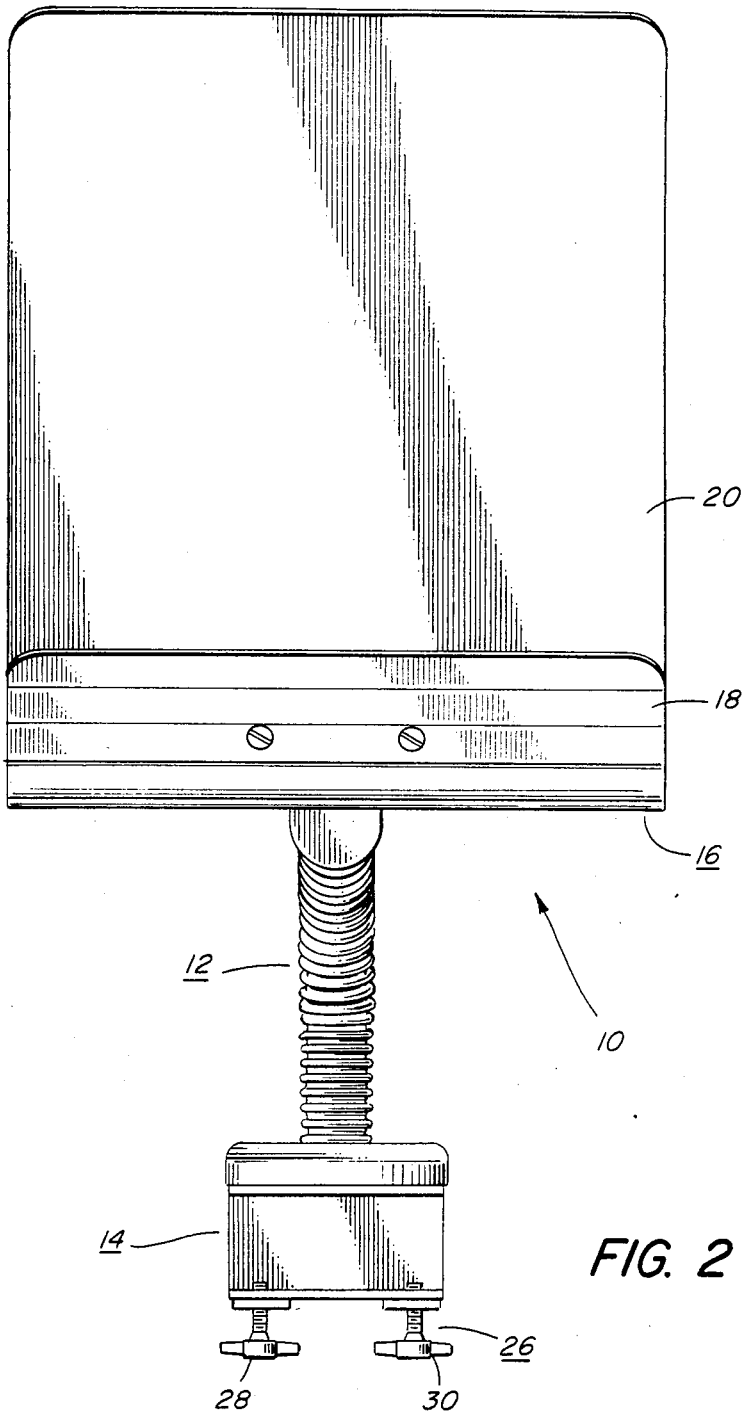
FIG. 2 is a front elevational view thereof.
Figure 3:
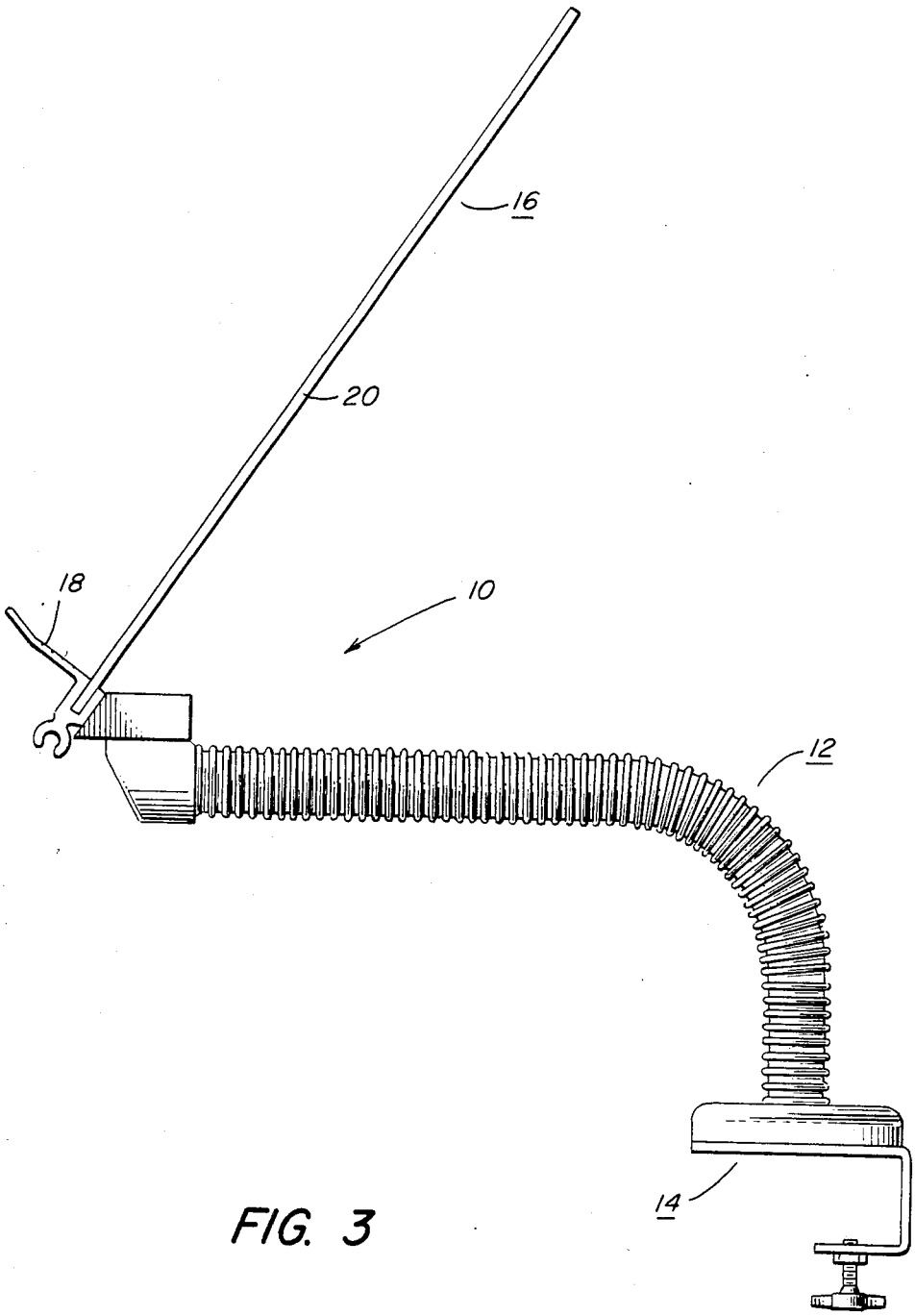
FIG. 3 is a right side elevational view thereof.

Referring now to the drawings in detail and in particular to FIGS. 1 through 3, there is shown a copyholder 10 made in accordance with the present invention. The copyholder includes an elongated flexible riser 12 preferably made from a flexible metal tube and connected between a clamping assembly 14 and a support unit 16.

The support unit 16 comprises a bottom ledge or platform 18 extending orthogonally from and connected to a planar support surface 20 or vertical rest 20. The support surface is designed to extend in a generally vertical direction (for example at an incline of 15° to 30° from the vertical) so as to hold reference materials including all types of media documents (not shown) at a reading angle. The ledge 18 is provided with a plurality of serations 22 or can otherwise be textured so as to improve traction between it and the media documents.

The clamp assembly comprises an immovable jaw 24 and a coacting moveable jaw 26 preferably in the form of a plurality of thumb screws 28 and 30 adjustable toward and away from the immovable jaw 24. The immovable jaw 24 is in the form of a "U" shaped channel. In use the clamp assembly is designed to receive between the immovable jaw 24 and the movable jaw 26 the top of a desk, work station table or other horizontal surface (not shown), and to clamp the copyholder 10 thereto. It should be readily understood, however, that the movable jaw 26 can comprise a common movable plate (not shown) rather than or in addition to the thumb screws 28 and 30.

In accordance with the present invention the flexible riser 12 is connected to the clamp assembly 14 and the support unit 16 pivotally so as to permit motion about vertical axes. This is highly desirable to meet the special demands of vertical line of sight operation of a computer entry terminal (not shown). The clamp assembly 14 must by necessity be placed at the edge of desk or table to which it is to be clamped. The support unit 16 is preferrably placed between the keyboard (not shown) and the video display (not shown) and be "squared up" relative to the operator so as to facilitate the operator's use of the reference materials supported by the copyholder 10. To that end the flexible riser 12 preferrably should be able to pivot relative to the clamp 14 about a vertical axis extending through their interconnection. In a similar fashion the support unit 16 preferrably should pivot relative to the flexible riser 12 about a vertical axis extending through their interconnection. This is in addition to the placement control offered by the flexible riser 12 itself, which can be manually bent to a variety of positions and, therefore, the copyholder 10 can be characterized as "goose-necked".

Figure 4:
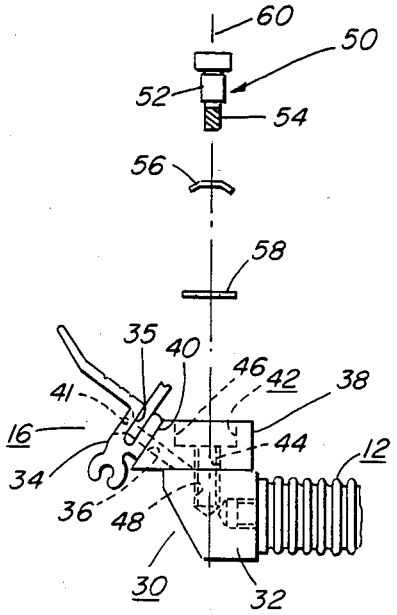
FIG. 4 is a detailed exploded view of the construction of the connection between the support unit and the flexible riser.

The interconnection means 30 between the flexible riser 12 and the support unit is shown in FIG. 4. The flexible riser 12 threadily engages a knuckleholder 32. The ledge 18 is preferably made integrally with a connecting portion 34 which includes a channel 35 disposed and sized to receive an edge of the support surface 20. The support surface 20 preferably is made from an anti-reflective material, for example, of plexiglass. A plurality of set screws 36 are disposed so as to tightly secure the support surface 20 within the channel 35. Interposed between the connecting portion 34 and the knuckleholder 32 is a pivot block 38. The pivot block 38 includes an inclined surface 40 to which the connecting portion 34 is attached via commonly known expedients such as connecting screws 41. The pivot block includes a stepped through- bore 42 including a threaded portion 44 thereof of a smaller diameter and a smooth surfaced portion 46 of greater diameter. The knuckleholder 32 includes a threaded bore 48 of equal diameter and alignable coaxially with the threaded portion 44 of the through bore 42. The through bore 42 and the bore 48 are designed to receive a shoulder screw 50 having a smooth surfaced shoulder portion 52 and a threaded end portion 54, designed to threadily engage the bore 48. A curved washer 56 as well as a flat washer 58 are designed to be interposed between the shoulder screw 50 and the interconnecting means 30 so as to maintain the shoulder bolt in tension after assembly. In operation the shoulder bolt 50 when it is screwed down into the knuckleholder 32 permits the pivot block 38 to pivot, swivel or otherwise rotate about a vertical axis identified at 60 and relative to the knuckleholder 32. To effect this rotation it should be clear that the diameter of the cylindrical portion 52 of the shoulder bolt 60 is less than the inner diameter of the portion 46 of the through- bore 42.

Figure 5:
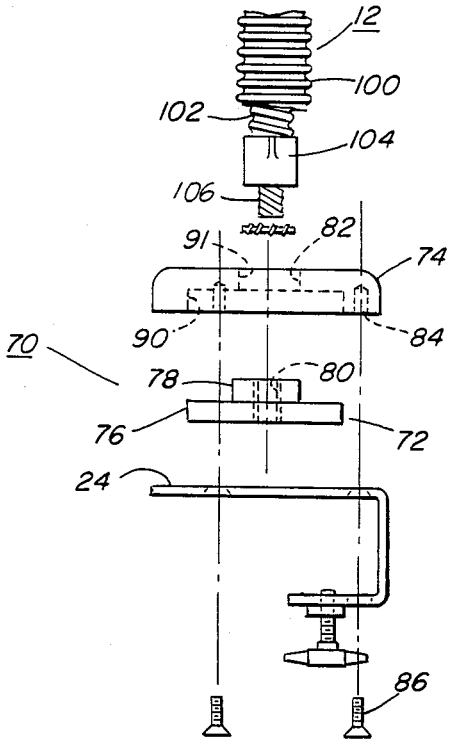
FIG. 5 is a detailed exploded view of the connection between the flexible riser and the clamp assembly.

The interconnection means 70 between the flexible riser 12 of the clamp assembly 14 is shown in FIG. 5. The interconnection means 70 includes a base pivot 72 interposed between a base pivot holder 74 and the immovable jaw 24 of the clamp assembly 14. The base pivot 72 comprises a first portion 76 and a second portion 78 of diameter less than the first portion 76 and a threaded through- bore 80. The base pivot holder 74 includes a stepped through- bore 82 as well as a plurality of blind holes 84 designed to receive screws 86. The stepped through- bore 82 includes a first portion 90 designed to receive portion 76 of the base pivot, and a second and narrower portion 91.

Prior to detailing the assembly of the interconnection means 70 it is necessary to describe the flexible riser 12. Riser 12 includes a bellows tube 100 preferably constructed of a plastic material. The bellows tube 100 extends over a metal flexible tube 102 and provides a pleasant aesthetic quality. A cylindrical block 104 having a threaded extention 106 is disposed on the end of the metal tube 102.

Assembly is as follows: The second portion 78 is received within the narrower portion 91 of the stepped through bore 82 with a sliding fit and the first portion 76 is received within the wider portion 90 of the stepped through bore 82 with a sliding fit. Screws 86 attach the immovable jaw 24 to the base pivot holder 74 by threadily engaging holes 84. Thus, it should be apparent that the flexible riser 12 is connected to the base pivot 72 which is captured and vertically contained between the clamp assembly 14 and the base pivot holder 74 so as to permit it to rotate within the base pivot holder 74.

Thus it can be seen that a copyholder has been provided which can meet the needs of a computer entry terminal and provide for vertical line of sight operation by a programmer.

It is intended that the description given herein be interpreted in an illustrative and not in a limiting sense since certain changes may be made to the above-described copyholder without departing from the scope and spirit of the invention.

We claim:

1. A copyholder comprising: a support unit including a support surface and a bottom ledge connected generally orthogonally thereto; a clamp assembly including an immovable jaw, and a movable jaw coacting therewith; a flexible riser connecting the clamp assembly to the support unit; and means for interconnecting the flexible riser to the clamp assembly comprising a base pivot connected to the flexible riser, and a base pivot holder connected to the clamp assembly; said base pivot receivable within a bore in the base pivot holder and vertically captured thereby for pivotal motion relative thereto, so as to permit pivotal motion of the clamp assembly relative to the flexible riser; wherein the base pivot comprises a first portion and a second portion axially connected to the first portion and having a diameter less than that of the first portion, and the base pivot holder's bore is a stepped through-bore sized and configured so as to receive therein said base pivot.

2. The copyholder of claim 1 further including means for interconnecting the support unit to the flexible riser, including a pivot block attachable to the support unit, a knuckleholder attachable to the flexible riser, said knuckleholder pivotally connected to the pivot block.

3. The copyholder of claim 2 wherein the interconnection means further includes a shoulder screw threadily engaging the knuckleholder and disposed within the pivot block.

4. The copyholder of claim 1 wherein said base pivot holder is releasably, fixedly secured to said clamp assembly and said base pivot is threadedly secured to the flexible riser and disposed such that its first portion is positioned between the clamp assembly and a portion of the base pivot holder.

5. The copyholder of claim 1 wherein the bottom ledge has a channel sized and configured to receive an edge of the support unit therein.

6. The copyholder of claim 5 wherein the support unit is maintained within the channel by a plurality of screws.

7. The copyholder of claim 5 wherein the bottom ledge has a textured top surface.

8. The copyholder of claim 5 wherein the bottom ledge has top surface with serrations.

9. The copyholder of claim 1 wherein the support unit is made of plexi-glass.

10. The copyholder of claim 1 wherein the flexible riser includes a flexible tube and a bellows tube extending over the flexible tube.

11. The copyholder of claim 10 wherein the bellows tube is made of plastic and the flexible tube is made of metal.

12. The copyholder of claim 2 wherein the pivot block includes an inclined surface to which the support unit is attached.

13. A copyholder comprising:

(a) a support unit including a support surface, a bottom ledge connected generally orthogonally thereto, said bottom ledge having a channel sized and configured to receive an edge of the support surface therein, and a connecting portion connected to the bottom ledge;

(b) a clamp assembly including an immovable jaw and a movable jaw coating therewith;

(c) a flexible riser pivotally connected to the clamp assembly and the support unit, said flexible riser being bendable so as to permit manual placement of the support unit;

(d) means for interconnecting the support unit and the flexible riser, including a knuckleholder threadedly engaging a first end of the flexible riser, a pivot block fixedly secured to the connecting portion of the support unit, and means for pivotally connecting the pivot block to the knuckleholder including a shoulder screw received through a through-bore in the pivot block into threaded engagement with a threaded hole in the knuckleholder, wherein said pivot block can rotate about a shoulder portion of the shoulder screw thereby permitting pivotal motion of the support unit relative to the flexible riser; and (e) means for interconnecting the flexible riser and the clamp assembly, including a base pivot comprising a first portion and a second portion axially connected to the first portion and having a diameter less than that of the first portion, a base pivot holder comprising a through-bore sized and configured so as to receive therein said base pivot, said base pivot holder fixedly secured to said clamp assembly, said base pivot threadedly secured to a second end of the flexible riser and captured vertically while rotatably disposed within the base pivot holder such that its first portion is positioned between the immovaable jaw and a portion of the base pivot holder, thereby permitting pivotal motion of the clamp assembly relative to the flexible riser.

14. The copyholder of claim 13 wherein the support unit is maintained within the channel by a plurality of screws.

15. The copyholder of claim 13 wherein the pivot block includes as inclined surface to which the support unit is attached.

* * * * *